United States Patent [19]

Brucato et al.

[11] Patent Number: 4,754,500

[45] Date of Patent: Jul. 5, 1988

[54] SPECIAL GARMENTS FOR THE DISABLED AND INFIRM

[76] Inventors: Norma J. Brucato, 5472 Courier Ct.; Ruth A. Lipps, 208 Pedretti Rd., both of Cincinnati, Ohio 45238

[21] Appl. No.: 863,435

[22] Filed: May 15, 1986

[51] Int. Cl.[4] ..... A41D 1/22

[52] U.S. Cl. ..... 2/105; 2/49 R; 2/114; 2/48

[58] Field of Search ..... 2/105, 114, DIG. 7, 2/49 R, 50, 48, 51, 52

[56] References Cited

U.S. PATENT DOCUMENTS

| | | | |
|---|---|---|---|
| D. 236,293 | 8/1975 | Banks | D2/17 |
| 459,106 | 9/1891 | Fifield | 2/114 |
| 646,194 | 3/1900 | Sims | 2/114 |
| 769,930 | 9/1904 | Alshuler | 2/48 |
| 974,981 | 11/1910 | Lee | 2/114 |
| 1,564,897 | 12/1925 | Sanborn | 2/48 |
| 2,124,366 | 7/1938 | DeLasarte | 2/114 |
| 2,262,010 | 11/1941 | Kuehne | 2/49 |
| 2,425,635 | 8/1947 | Nitzberg | 2/49 R |
| 2,528,340 | 10/1950 | Coven | 2/114 |
| 2,528,630 | 11/1950 | Winkler | 2/114 |
| 2,686,914 | 8/1954 | Weiser | 2/114 |
| 2,760,200 | 8/1956 | Shamyer | 2/49 |
| 3,824,625 | 7/1974 | Green | 2/114 |
| 3,871,027 | 3/1975 | Orr | 2/49 R |
| 3,979,776 | 9/1976 | Gruenwald | 2/49 R |
| 4,079,465 | 3/1978 | Alexander | 2/48 |
| 4,186,443 | 2/1980 | Britzman | 2/49 R |
| 4,258,440 | 3/1981 | McGowan | 2/114 |
| 4,296,497 | 10/1981 | Herman | 2/114 |
| 4,370,757 | 2/1983 | Richmond | 2/400 |
| 4,382,303 | 5/1983 | Lunt | 2/114 |
| 4,383,335 | 5/1983 | Slocum | 2/114 |
| 4,422,186 | 12/1983 | Loney | 2/114 |
| 4,434,511 | 3/1984 | Weiser | 2/114 |
| 4,446,575 | 5/1984 | Davis | 2/400 |

OTHER PUBLICATIONS

M & M Health Care Apparel Co., 1541 60th Street, Brooklyn, N.Y., 11219, Product Catalogue, ©M & M Health Care Apparel Co., 1983, cover, pp. 1, 3, 13, 14, 25, 26.

*Primary Examiner*—Louis K. Rimrodt
*Assistant Examiner*—Judith L. Olds
*Attorney, Agent, or Firm*—George P. Brandenburg

[57] ABSTRACT

Special garments for the disabled and infirm are provided with a front and back portion to enclose a portion of a person wherein the front is comprised of an inner front portion and a removable outer front portion. The inner front portion of the garment includes an outer face of a selected design and material having a fastening means disposed about a selected area thereon. The outer front portion comprises an outer face of design and material matched with the selected design and material of the outer face of the inner front portion and an inner face which is fluid resistant and includes a fastening means about an area matched with the selected area of the inner front portion, designed to align and cooperate with the first fastening means to releasably attach together the outer face of the inner front portion and the inner face of the outer front portion forming a removable bib-like portion which matches the garment portion. The garment also is divided along a split in its vertical height into two back portions, each including cooperating releasable fastening means to enable the user to secure together and separate the two back portions. The garment is particularly beneficial to incontinent individuals and individuals susceptible to drooling or having feeding problems.

5 Claims, 2 Drawing Sheets

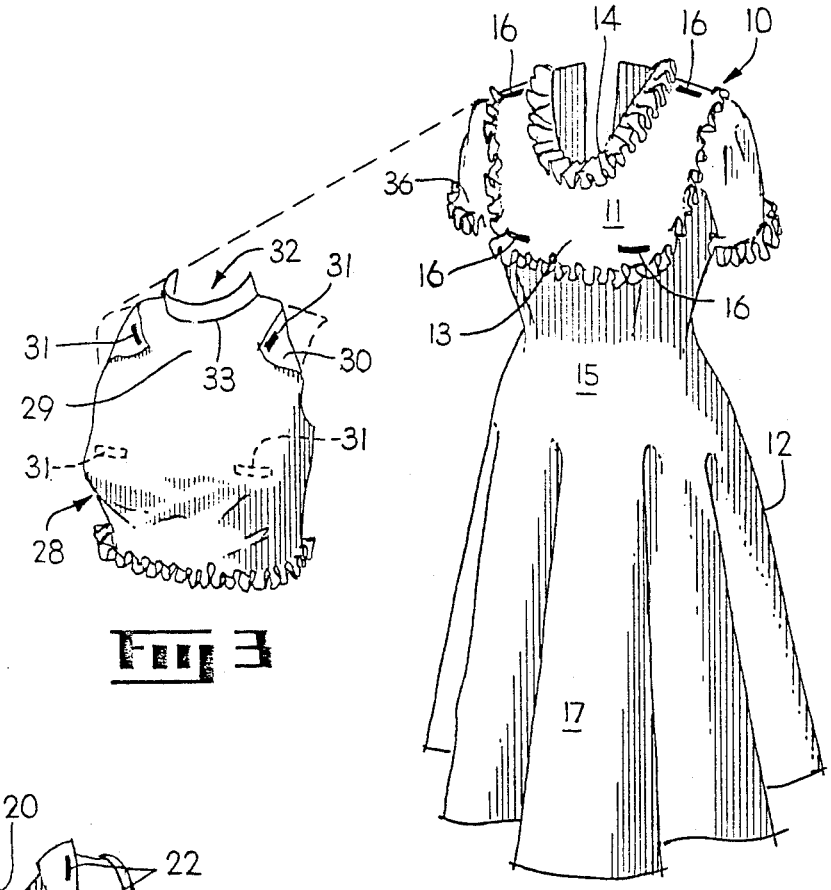
Fig 1
Fig 3
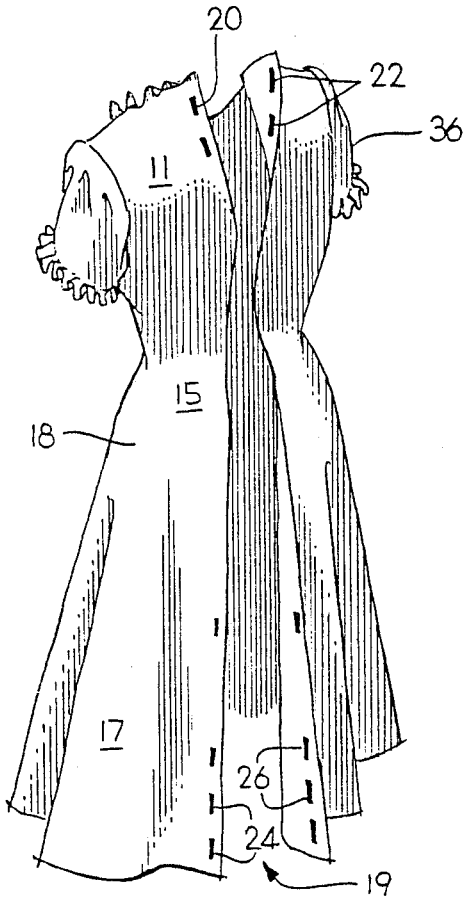
Fig 2
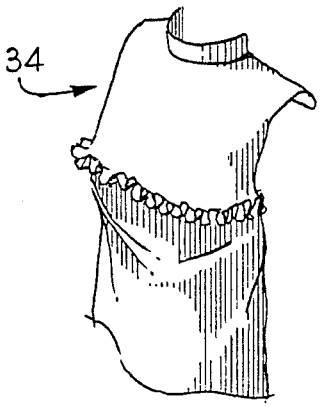
Fig 4

SPECIAL GARMENTS FOR THE DISABLED AND INFIRM

BACKGROUND OF THE INVENTION

1. Field of the Invention

This invention relates generally to garments and more particularly to garments designed to provide special fashions for the disabled and infirm, especially individuals having a problem of incontinence and/or drooling, said special clothing being both functional yet attractive and stylish.

2. Description of the Prior Art

Various decorative and stylish skirts and dresses have been designed and are known in the art for use, by the disabled and infirm, and which contain a slit or separation in the material. Additionally, various hospital gowns and robes well known in the art also contain either front or back opening and closure means and attachment means associated therewith.

Various articles such as bibs for the protection of outer garments are well known in the art. A distinction between the prior art garments containing slits or openings and the prior art protective garments, and the garment of the present invention, is that there is no single prior art garment used in combination both for protection as well as in a decorative manner.

Various residents of nursing homes suffering from arthritis, crippled arms, tight joints, paralized limbs, etc. have a special need for clothing that is easy to dress with, yet which is stylish and attractive. Further still, for those individuals who are incontinent and/or wheel chair bound, special clothing is needed that will accommodate those individuals yet still be attractive and stylish. Further, individuals who have a drooling problem due to stroke, different diseases, or just being unable to control their saliva have a special clothing need. Drool can soak the front of a dress, blouse, or shirt and be embarassing to the individual. Further, because of arthritic conditions or crippling in the hands it is hard for some people to feed themselves without getting the food on the front of their dress or shirt.

Patients are generally dressed in bath robes, such that the robes are put on in a normal manner. For those individuals having an incontinence problem of bladder or bowel functions, when placed in a wheel chair have the rear portion of the bath robe raised so that the patient is seated directly upon the wheel chair seat, reducing any potential for the robe to become soaked or soiled.

Another practice is for the individual to have the bath robe placed on backwards for ease in dressing. This practice becomes inconvenient to the wearer because the often large collar in some instances becomes too tight when the robe is closed in the back. In other instances, the collar is so high it often touches the chin in an irrating manner. Further, a robe worn in this way is bulky and unattractive.

Using either of the two dressing methods just discussed, the backs and buttocks of the individual are often exposed. Such a practice leads to obvious embarassment of the individual and often results in their lack of desire to participate in any sort of group function. Further, the problem of incontinence becomes obvious to one near the individual.

Various patents have been issued which are an attempt to solve the problems discussed above as well as to provide a garment which will be both functional, for the specific needs of the disabled and infirm, as well as practical in use. A detailed summary of such prior art is found in U.S. Pat. No. 4,383,335 entitled "Robe Adapted for Incontinent Individuals" by Patricia K. Slocum. U.S. Pat. No. 4,383,335 shows a garment having a continuous front and an opening in the back which allows for the easy insertion of a bed pan or the like providing a modicum of privacy for the wearer.

Relating to the drooling and feeding problem, bibs now in use have no backing and are unattractive and inefficient. Bibs currently known in the art are generally of a one piece design, designed to cover the upper front portion of the user, and generally tie or snap in the back.

SUMMARY OF THE INVENTION

A primary object of the invention is to provide an attractive and stylish yet protective garment, the wearing of which will promote dignity and confidence of the wearer, enabling the wearer to participate in social functions and to lead a near normal life.

A second object of the invention is to provide a bib of like material removably attachable to the wearer's garment, which looks like the first garment of the wearer, and which includes protective material on the back to keep the garment material dry.

Another object of the invention is to provide a dress which will cover the wearer when seated yet will open in the back to prevent the dress from becoming soaked or soiled as a result of incontinence of the wearer.

Still, a further object of the invention is to provide a garment which will close in the back when the wearer is standing to avoid embarassment.

Yet another object is to provide a means of hiding a restraining jacket often worn by the elderly, disabled or infirm, which will eliminate embarassment of the wearer and promote self-confidence.

Other objects, features and advantages of the invention will be apparent with the following detailed description taken in conjunction with the accompanying drawings showning preferred embodiments of the invention.

The present invention, in one form, provides a garment body defined by a front and back to enclose a portion of the person wherein the front is comprised of an inner front portion intergral with the body and a removable outer front portion. The inner front portion includes an outer face of a selected design and material, said outer face having a fastening means disposed about a selected area thereon. The outer front portion comprises an outer face of design and material matched with a selected design of material of the outer face of the inner front portion and an inner face which is fluid resistant and includes a second fastening means about an area matched with the selected area, the second fastening means being disposed to align and cooperate with the first fastening means to releasably attach together the outer face of the inner front portion and the inner face of the outer front portion. In one form, the garment further has the back thereof divided along a split in its vertical height into two back portions, each including cooperating releasable fastening means to enable securing together and separating the two back portions. The present invention allows the wearer to interchangably attach the outer front portion, or bib portion as required, and further allows the wearer to be seated in such a fashion that should incontinence occur, the incontinence will not soil or soak the garment of the wearer. The present invention further allows the garment to be closed when standing to fully protect the body of the wearer and to reduce embarassment.

BRIEF DESCRIPTION OF THE DRAWINGS

In the drawings:

FIG. 1 is a frontal view of a portion of the garment of the present invention.

FIG. 2 is a rear view of the garment of FIG. 1.

FIG. 3 is a frontal view of the outer front bib-like portion of the present invention which together with the portion in FIG. 1 comprises one form of the garment of the present invention.

FIG. 4 is an alternate embodiment of the outer front bib-like portion of the present invention.

DESCRIPTION OF THE PREFERRED EMBODIMENT

Figures 5, 6:
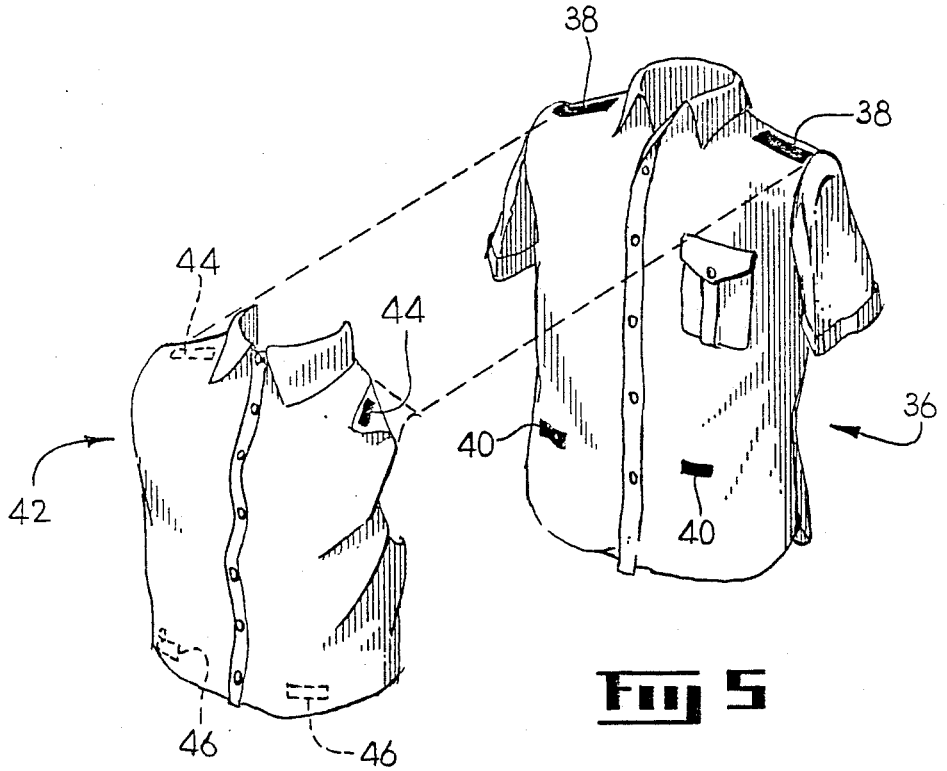
FIG. 5 is a frontal view of an alternate embodiment of a portion of the garment of the present invention.
FIG. 6 is a frontal view of the outer front portion of the present inventio which is releasably attachable to the embodiment shown in FIG. 5 to form the garment of the present invention.

Referring more particularly to the drawing, wherein like numbers refer to like parts in each view, FIG. 1 illustrates a special fashion for the disabledd or infirm wherein a simple clothing garment 10 is shown. Garment 10 comprises a front portion 12 and a back portion 18, shown in FIG. 2. The front portion 12 and the back portion 18 of garment 10 is designed to enclose a portion of a person. Front portion 12 includes an inner front portion 13 and an opening 14 for the neck of the wearer and fastening means 16 attached to the shoulder of the garment.

Fastening means 16 may be any of various fastening means comprised of the group of snaps, buttons, VELCRO, bows, etc.

FIG. 2 more clearly details the back portion of the garment wherein the back portion is divided along a split in its vertical height shown generally at 19. Vertical split 19 divides the garment into two back portions, each including cooperating releasable fastening means 20 and 22 at its upper portion and cooperating releasable fastening means 24 and 26 at its lower back portion. Again, said fastening means may be any of the group of snaps, buttons, VELCRO, bows, etc.

The garment shown in FIGS. 1 and 2 may be in the form of a woman's dress which includes a bodice portion shown generally as at 11 in FIG. 1 and FIG. 2. Said bodice portion extending to a waist section, shown generally at 15 in FIG. 1 and FIG. 2, and a skirt portion 17 below the waist portion 15 wherein the cooperating releasable fastening means is disposed substantially, completely along the split in the bodice portion at 20 and 22 and intermittently along the split in the skirt portion at 24 and 26. The garment further includes sleeves 36, shown in FIG. 1 and FIG. 2, and a neck portion 14 shown in FIG. 1.

In order to protect the wearer from drooling or the spillage of food or the like, a bib-like or removable outer front portion 29 is provided, FIG. 3, for placement over the inner front portion 11 shown in FIG. 1. The inner front portion 11, FIG. 1 includes an outer face of a selected design and material, said outer face having a first fastening means 16 disposed about a selected area thereon, as shown generally about the bodice area of the garment 10 in FIG. 1.

The outer front portion 29, FIG. 3 is of a design and material matched with the selected design and material of the outer face of the inner front portion 11, FIG. 1. The outer front portion 29, FIG. 3 comprises an inner face portion 30 which is fluid resistant and includes a second fastening means 31 disposed about an area matched with the selected area 16, shown in FIG. 1. Fluid resistance can be provided to the inner face portion 30 by a variety of means including treatment of the face with a fluid resistant material as by coating, by laminating or otherwise attaching a plastic material or sheeting, etc. The second fastening means 31, shown in FIG. 3, is disposed to align and cooperate with the first fastening means to releasably attach together the outer face of the inner front portion and the inner face of the outer front portion. The bib-like garment 29, shown in FIG. 3 includes an elevated neck area 33 to cover the neck portion 14 of the garment of FIG. 1, and material sufficient to cover at least a portion of the waist area and substantially the area between the sleeves 36 of FIG. 1.

It is to be understood by one skilled in the art that the outer face of the front portion 32, shown in FIG. 3 may be of the same design and material as the selected design and material of the garment 10 of FIG. 1. It may also be of a material matched with the selected design and material of the garment 10 of FIG. 1. One enhancing provision of the present invention is that the outer front portion 32 may be placed over the selected area of the garment 10 with a minimum of visual disparity such that it would appear to an observer that the individual was not wearing a bib-like material.

The outer front portion 32 is shown as a short waisted design member. An alternate embodiment is shown in FIG. 4, wherein the outer front portion 34 is shown as a long-waisted designed member.

A further alternate embodiment is shown in the combination of FIGS. 5 and 6, wherein the garment 36 is such as a man's shirt, but may be a woman's blouse. In FIG. 5, a first fastening means 38 is disposed about the shoulders of garment 36. A second fastening means 40 is disposed about the waistline of garment 36. It should be realized by one skilled in the art that such fastening means may be any from the group of snaps, buttons, VELCRO, bows, etc. The outer front portion 42 of the alternate embodiment 36 is shown in FIG. 6. Said outer front portion is similar to the outer front portion previously described, including a neck portion, at least a portion of the waist area and substantially the area between the sleeves. The inner face portion of the outer front portion 42 likewise has an inner face which is fluid resistant and includes a fastening means about an area matched with the selected area of alternate embodiment 36. The fastening means 44 and 46 shown in FIG. 6 are designed to cooperate in a releasable fastening means with fastening means 38 and 40 of alternate embodiment 36, shown in FIG. 5.

It is understood that the invention is not confined to the particular construction, materials, and arrangement of parts herein illustrated and described. Instead, it embraces all such modified forms thereof as should be obvious to those skilled in the art. The invention embraces all modified forms that come within the scope of the following claims.

We claim:

1. An improved garment comprising a garment body defined by a front and a back to enclosed a portion of a person wherein:

the front is comprised of an inner front portion integral with the body and a removable outer front portion;

the inner front portion including an outer face of selected design and material, said outer face having first fastening means disposed about a selected area thereon;

the outer front portion comprising:

(a) an outer face of design and material matched with the selected design and material of the outer face or the inner front portion, and (b) an inner face which is fluid resistant and includes a second fastening means about an area matched with the selected area, the second fastening means being disposed to align and cooperte with the first fastening means to releasably attach together the outer face of the inner front portion and the inner face of the outer front portion;

the improvement wherein the first fastening means and second fastening means are disposed to align and cooperate with each other to releasably attach together, said fastening means being concealed within the space formed by the inner front portion integral with the body and the inner face of the outer front portion.

2. The garment of claim 1 in which in combination the back is divided along a split in its vertical height into two back portions each including cooperating releasable fastening means to enable securing together and separating the two back portions, said cooperating releasable fastening means being concealed within the space formed by the two back portions.

3. The garment of claim 2 in the form of a woman's dress including a bodice portion to a waist and a skirt portion below the waist wherein the cooperating releasable fastening means is disposed substantially completely along the split in the bodice portion and intermitently along the split in the skirt portion, said cooperating releasable fastening means being concealed within the space formed between the bodice portion and skirt portion closures.

4. The garment of claim 1 which includes sleeves, a neck and a waist area wherein the selected area of the inner front portion and the outer front portion includes the neck, at least a portion of the waist area and substantially the area between the sleeves.

5. The garment of claim 4 in which:

the outer face of the front portion is of the same design and material as the selected design and material; and the inner face of the outer front portion is a plastic material secured with the outer face of the outer front portion.

* * * * *